US009250597B2

(12) United States Patent
Tsuchihashi et al.

(10) Patent No.: US 9,250,597 B2
(45) Date of Patent: Feb. 2, 2016

(54) FOREIGN MATTER REMOVING APPARATUS, COLOR ERASING APPARATUS, AND FOREIGN MATTER REMOVING METHOD

(75) Inventors: Hiroyuki Tsuchihashi, Shizuoka (JP); Isao Yahata, Shizuoka (JP); Takahiro Kawaguchi, Shizuoka (JP); Hiroyuki Taguchi, Shizuoka (JP); Ken Iguchi, Shizuoka (JP); Hiroyuki Taki, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 1358 days.

(21) Appl. No.: 13/027,180

(22) Filed: Feb. 14, 2011

(65) Prior Publication Data

US 2011/0220305 A1 Sep. 15, 2011

Related U.S. Application Data

(60) Provisional application No. 61/314,097, filed on Mar. 15, 2010.

(51) Int. Cl.
*B02C 18/00* (2006.01)
*G03G 15/00* (2006.01)
*B65H 37/00* (2006.01)

(52) U.S. Cl.
CPC ..... *G03G 15/65* (2013.01); *B02C 18/0007* (2013.01);

(Continued)

(58) Field of Classification Search
CPC ..... D21B 1/32; G03G 15/20; B02C 18/0007; B02C 2018/003; B02C 18/00
USPC ..... 241/30, 236, 81; 399/343, 350; 347/179
See application file for complete search history.

(56) References Cited

U.S. PATENT DOCUMENTS 8,427,516 B2 * 4/2013 Kawaguchi et al. ..... 347/171
8,489,010 B2 * 7/2013 Taki et al. ..... 399/341

FOREIGN PATENT DOCUMENTS

GB 2497699 * 6/2013
JP 06-255138 9/1994

OTHER PUBLICATIONS

Office Action dated Jan. 24, 2014 in counterpart Japanese Patent Application 2011-033213 (with English Translation).
Hiroyuki Tsuchihashii, U.S. Appl. No. 12/838,228, filed Jul. 16, 2010.

(Continued)

*Primary Examiner* — Mark Rosenbaum
(74) *Attorney, Agent, or Firm* — Patterson & Sheridan, LLP

(57) ABSTRACT

A foreign matter removing apparatus includes: a removing plate disposed above a recording medium carriage path, a first sensor and a second sensor which interpose the removing plate therebetween at equal distances in a carriage direction of the recording medium and are disposed on both sides of the recording medium carriage direction, a first plate and a second plate which come in contact with each other at a position below the removing plate, and are disposed at positions opposed to the first sensor and the second sensor while interposing the recording medium carriage path therebetween so as to be opened and closed in a direction perpendicular to the recording medium carriage direction, a first driving roller disposed between the first sensor and the removing plate, and a second driving roller disposed between the second sensor and the removing plate.

20 Claims, 6 Drawing Sheets

(52) U.S. Cl.
CPC ..... *B65H 37/00* (2013.01); *B65H 2301/51115* (2013.01); *B65H 2301/51121* (2013.01); *B65H 2404/1442* (2013.01); *B65H2511/51* (2013.01); *G03G 2215/00531* (2013.01); *G03G 2215/00708* (2013.01); *G03G 2215/00759* (2013.01)

(56) References Cited

OTHER PUBLICATIONS

Hiroyuki Taki, U.S. Appl. No. 12/848,918, filed Aug. 2, 2010.

* cited by examiner

FOREIGN MATTER REMOVING APPARATUS, COLOR ERASING APPARATUS, AND FOREIGN MATTER REMOVING METHOD

CROSS-REFERENCE TO RELATED APPLICATIONS

This application is based upon and claims the benefit of priority from the prior the U.S.A. Patent Application No. 61/314097, filed on Mar. 15, 2010, and the entire contents of which are incorporated herein by reference.

FIELD

The present invention relates to a foreign matter removing apparatus, a color erasing apparatus, and a foreign matter removing method.

BACKGROUND

In order to save resources, image formation may be performed using color-erasable developing materials. As the color-erasable developing materials, there are toner, ink, and the like, the color of which is made to disappear by heat. A recording medium in which an image is formed using the color-erasable developing materials is heated by a color erasing apparatus and reused after color erasure.

However, there may be a case where foreign matter such as clips, staples, and sticky notes is attached to the recording medium inserted into the color erasing apparatus. When the recording medium with the foreign matter attached is carried, jamming occurs in the color erasing apparatus, incomplete color erasure occurs, or the color erasing apparatus may be damaged.

From this point of view, a charging apparatus which charges foreign matter is provided in a recording medium carriage path, and a technique for pressing the foreign matter using an endless belt and a roller so as to be removed or a technique for removing the foreign matter using a brush and a magnet are proposed.

However, even in such techniques, there is a possibility that the foreign matter will remain on the recording medium. Therefore, a foreign matter removing apparatus, a color erasing apparatus, and a foreign matter removing method capable of removing foreign matter from a recording medium more reliably are required.

DETAILED DESCRIPTION

Throughout this description, the embodiments and examples shown should be considered as exemplars, rather than limitations on the apparatus and methods of the present embodiments.

Hereinafter, a foreign matter removing apparatus, a color erasing apparatus, and a foreign matter removing method according to an embodiment will be described in detail.

The foreign matter removing apparatus according to this embodiment includes: a removing plate which is disposed above a recording medium carriage path; a nipping plate which is disposed at a position opposed to the removing plate with the recording medium carriage path interposed therebetween; and a first sensor and a second sensor which interpose the removing plate therebetween at equal distances in a carriage direction of the recording medium and are disposed on both sides in the recording medium carriage direction.

The color erasing apparatus according to this embodiment includes: a recording medium carrying mechanism which carries a recording medium; a removing plate which is disposed above a recording medium carriage path; a nipping plate which is disposed at a position opposed to the removing plate with the recording medium carriage path interposed therebetween; a first sensor and a second sensor which interpose the removing plate therebetween at equal distances in a carriage direction of the recording medium, the first sensor being disposed on an upstream side of the recording medium carriage direction, the second sensor being disposed on a downstream side of the recording medium carriage direction; and a heating roller which is installed on the downstream side of the recording medium carriage direction of the first sensor and the second sensor to heat the recording medium at a color-erasing temperature or higher.

Figure 1:
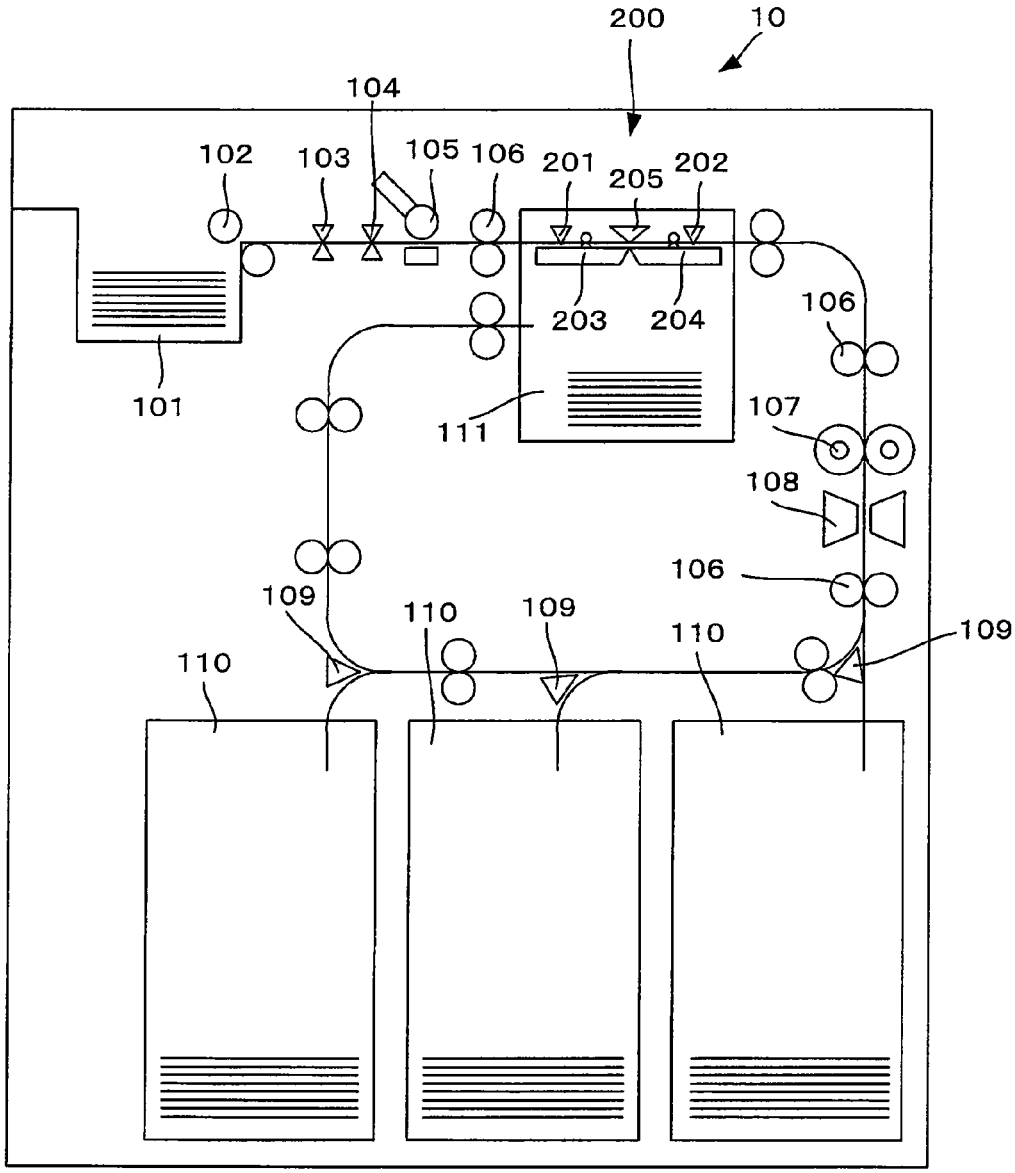
FIG. 1 is a side view of a color erasing apparatus including a foreign matter removing apparatus.

FIG. 1 is a side view of a color erasing apparatus 10 including a foreign matter removing apparatus. As illustrated in FIG. 1, the color erasing apparatus 10 includes an inlet tray 101 in which recording media to be subjected to color erasure are placed, a pickup roller 102 which picks up the recording media placed in the inlet tray 101 sheet by sheet, a passage sensor 103 which detects passage of the recording medium, a multiple-feed sensor 104 which detects multiple-feed of the recording media, a thickness sensor 105 which detects the thickness of the recording medium, a carrying roller 106 which carries the recording medium, a foreign matter removing apparatus 200 which removes foreign matter attached to the recording medium, a heating roller 107, as the heating device, configured to heat the recording medium to temperature equal to or higher than erasing temperature, an image detecting sensor 108 which detects whether or not an image on the recording medium is erased, a switching apparatus 109 which switches between carriage paths of the recording medium, a reuse box 110 which accumulates the recording media that are reusable, a waste box 111 which accumulates the recording media that are not reusable, and a control unit.

The multiple-feed sensor 104 causes, for example, ultrasonic waves to pass through the recording medium from the one side to the other side thereof and outputs a level of the passing ultrasonic waves. The control unit determines a multiple feed on the basis of the level.

The thickness sensor 105 causes an actuator to come in contact with the recording medium, transmits a movement of the actuator to a permanent magnet, detects a movement of the permanent magnet using a magnetic sensor, and outputs a signal corresponding to the thickness of the recording medium. The control unit determines the thickness of the recording medium on the basis of the output signal.

The heating roller 107, as the heating device, is formed of metal and has a heater therein. The heating roller 107 heats a color-erasable developing material on the recording medium to a color-erasing temperature or higher to erase the color in the recording medium.

Any heat source may be used for the heating devices as long as the devices can heat the recording media to the color erasing temperature or higher. For the heating devices, for example, thermal heads, halogen heaters, graphite heaters, IH (Induction Heater), rollers formed by heat conducting materials with heat generating lamps inside, or the like may be employed.

Any heat source which heats the recording media without contacting also may be employed for the heating devices.

The color-erasable developing material includes coloring compounds, developers, and color erasers. Examples of the coloring compounds may include leuco dye. Examples of the developers may include phenols. The color erasers may include materials which are compatible with the coloring compounds when heated and do not have affinity with the developers.

The color-erasable developing materials produce color by an interaction between the coloring compounds and the developers, and since the interaction between the coloring compounds and the developers is ended due to the heating to the color-erasing temperature or higher, this results in color erasure.

A recording medium which has an image for which color is not erased and thus is determined as a medium which is impossible to be reused is accumulated in the waste box 111 via the recording medium carriage path switched by the switching apparatus 109.

The foreign matter removing apparatus 200 is provided with: a first sensor 201 and a second sensor 202 which detect existence of the recording medium, a removing plate 205 which removes foreign matter such as clips, staples, or sticky notes attached to the recording medium, a removing plate driving apparatus 212 which elevates the removing plate 205, a first plate 203 and a second plate 204 which are nipping plates for pulling the recording medium with the removing plate 205, a first plate driving apparatus 215 which opens and closes the first plate 203, a second plate driving apparatus 216 which opens and closes the second plate 204, and the waste box 111 which accumulates the recording medium to be discarded and the removed foreign matter.

The foreign matter removing apparatus 200 is installed on an upstream side of a recording medium carriage direction of the heating roller 107.

The first plate 203 is installed closer to the upstream side of the recording medium carriage direction than the second plate 204. The first plate 203 and the second plate 204 are installed under a recording medium passage position of the recording medium carriage path.

The second sensor 202 is installed on the downstream side of the recording medium carriage direction of the first sensor 201. The first sensor 201 is installed on the upstream side of the recording medium carriage direction from a contact point between the first plate 203 and the second plate 204. The second sensor 202 is installed on the downstream side of the recording medium carriage direction from the contact point between the first plate 203 and the second plate 204. The first sensor 201 and the second sensor 202 are installed on the upstream side of the recording medium passage position of the recording medium carriage path.

The types of the first sensor 201 and the second sensor 202 are not limited. The first sensor 201 and the second sensor 202 may use any of optical sensors, infrared sensors, and mechanical sensors including actuators.

The first plate 203 has two sub-plates, and the two sub-plates are opened in a direction perpendicular to the recording medium carriage direction by the first plate driving apparatus 215. The second plate 204 has two sub-plates, and the two sub-plates are opened in the direction perpendicular to the recording medium carriage direction by the second plate driving apparatus 216.

The removing plate 205 has a triangular cross-section and is formed in a columnar shape. The removing plate 205 is installed above the recording medium passage position of the recording medium carriage path. The removing plate 205 is installed above the contact point between the first plate 203 and the second plate 204. The removing plate 205 is disposed so that one side of side surfaces thereof is perpendicular to the recording medium carriage direction.

Therefore, above the recording medium carriage position of the recording medium carriage path, from the upstream side of the recording medium carriage direction, the first sensor 201, the removing plate 205, and the second sensor 202 are disposed in this order. Under the recording medium carriage position, the first plate 203 and the second plate 204 are disposed in this order. The first sensor 201 and the second sensor 202 interpose the removing plate 205 therebetween at equal distances in the recording medium carriage direction and are disposed on both sides of the recording medium carriage direction. The first plate 203 and the second plate 204 which are able to open and close in the direction perpendicular to the recording medium carriage direction come in contact with each other at a position under the removing plate 205.

The foreign matter removing apparatus 200 has the waste box 111 below the first plate 203 and the second plate 204.

Figure 2:
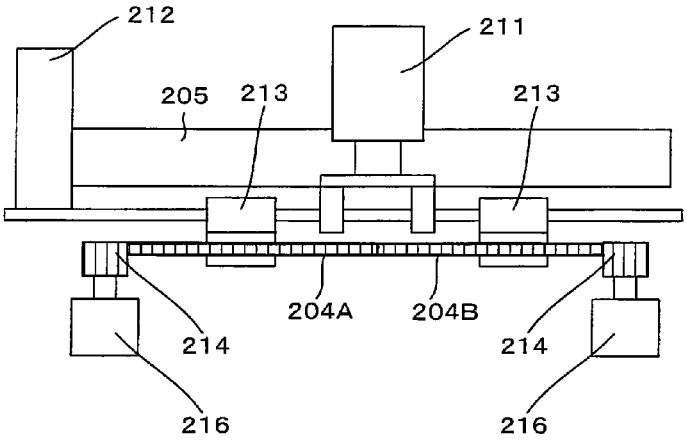
FIG. 2 is a diagram of the foreign matter removing apparatus during recording medium carriage as viewed from a downstream side to an upstream side in a recording medium carriage direction.

FIG. 2 is a diagram of the foreign matter removing apparatus 200 during recording medium carriage as viewed from the downstream side to the upstream side in the recording medium carriage direction. As illustrated in FIG. 2, the foreign matter removing apparatus 200 includes a first driving roller 217 (see FIG. 5) and a second driving roller 213 which carry the recording medium, a driving roller elevating apparatus 211 which elevates the second driving roller 213, a removing plate driving apparatus 212 which elevates the removing plate 205, a first plate driving apparatus 215 which opens and closes the sub-plate 203A and the sub-plate 203B of the first plate 203, and a second plate driving apparatus 216 which opens and closes sub-plate 204A and the sub-plate 204B of the second plate 204.

The first plate driving apparatus 215 and the second plate driving apparatus 216 include motors and gears 214. Peripheral portions of the sub-plate 203A, the sub-plate 203B, the sub-plate 204A, and the sub-plate 204B have teeth in mesh with the gear 214.

As the motor of the first plate driving apparatus 215 is rotated forward and reversed, the first plate 203 is opened and closed, and as the motor of the second plate driving apparatus 216 is rotated forward and reversed, the second plate 204 is opened and closed.

Figure 3:
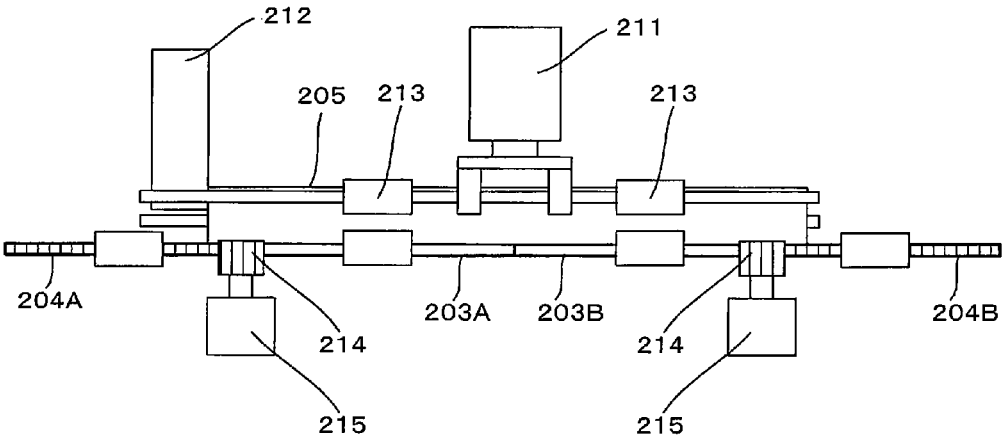
FIG. 3 is a diagram of the foreign matter removing apparatus during foreign matter removal by a first plate as viewed from the downstream side to the upstream side of the recording medium carriage direction.

FIG. 3 is a diagram of the foreign matter removing apparatus 200 during the foreign matter removal by the first plate 203 as viewed from the downstream side to the upstream side of the recording medium carriage direction. As illustrated in FIG. 3, during the foreign matter removal by the first plate 203, the driving roller elevating apparatus 211 lifts the driving roller 213, the removing plate driving apparatus 212 lowers the removing plate 205, and the second plate driving apparatus 216 opens the second plate 204.

Figure 4:
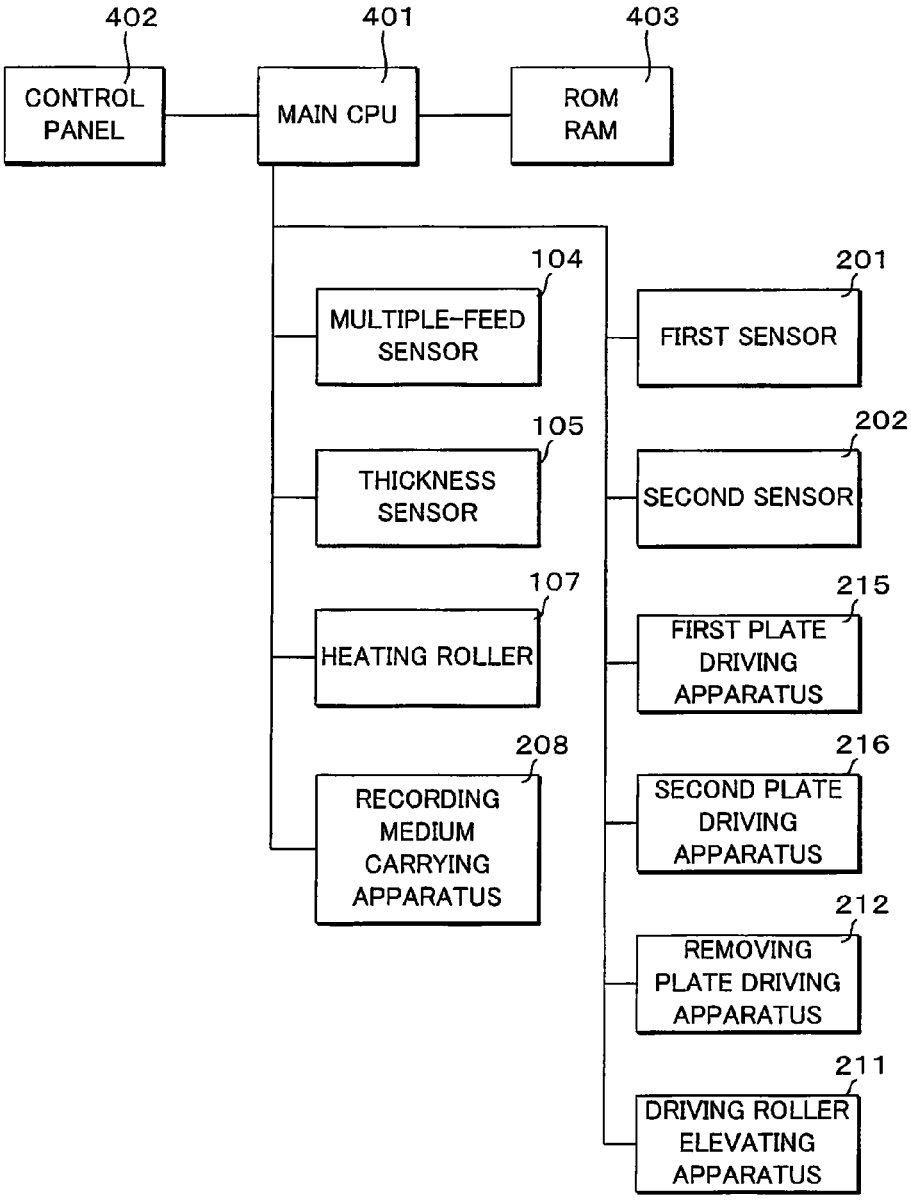
FIG. 4 is a block diagram illustrating a configuration of the color erasing apparatus.

FIG. 4 is a block diagram illustrating a configuration of the color erasing apparatus 10. As illustrated in FIG. 4, the color erasing apparatus 10 includes a main CPU 401 as the control unit, a control panel 402 as a display apparatus, and a ROM and RAM 403 as a storage apparatus.

The control panel 402 displays a screen for selecting whether or not a foreign matter removing operation is to be performed, and when an instruction to perform the foreign matter removing operation is input, the control unit may cause the foreign matter removing operation to be performed.

The main CPU 401 is connected to the multiple-feed sensor 104 included in the color erasing apparatus 10 and the thickness sensor 105 and inputs an output of the sensors. The main CPU 401 is connected to the heating roller 107 and a recording medium carrying apparatus 208 and controls operations of the apparatuses.

The main CPU 401 is connected to the first sensor 201 and the second sensor 202 and inputs an output of the sensors.

The main CPU 401 is connected to the first plate driving apparatus 215, the second plate driving apparatus 216, the removing plate driving apparatus 212, and the driving roller elevating apparatus 211 and controls operations of the apparatuses.

Figure 5:
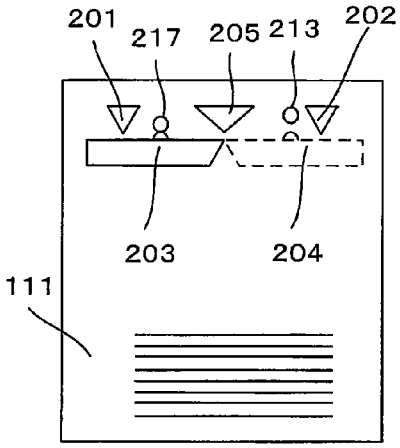
FIG. 5 is a diagram illustrating an operation performed by the foreign matter removing apparatus when a recording medium is inserted.

FIG. 5 is a diagram illustrating an operation performed by the foreign matter removing apparatus 200 when a recording medium is inserted. As illustrated in FIG. 5, when the recording medium is inserted into the foreign matter removing apparatus 200, the foreign matter removing apparatus 200 closes the first plate 203, lowers the first driving roller 217, opens the second plate 204, lifts the second driving roller 213, and lifts the removing plate 205.

Figure 6:
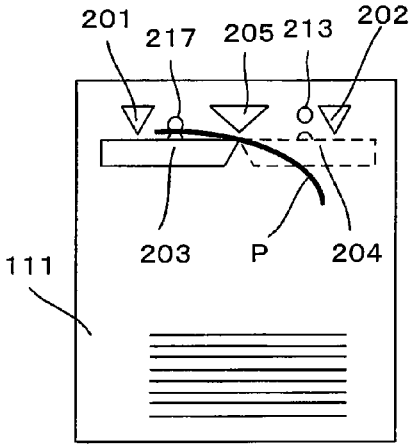
FIG. 6 is a diagram showing an operation during carriage of the first half part of a recording medium of the foreign matter removing apparatus.

FIG. 6 is a diagram showing an operation during the carriage of the first half part of the recording medium of the foreign matter removing apparatus 200. As illustrated in FIG. 6, in the foreign matter removing apparatus 200, the recording medium P is carried by the first driving roller 217 and a driven roller which is rotated along the first driving roller 217 until the recording medium is not detected after the first sensor 201 detects the recording medium. Therefore, the first half part of the recording medium P hangs down inside the waste box 111.

Here, a distance from the position of the first sensor 201 to a nip position of the removing plate 205 and the first plate 203 is a length of ½ the length of the recording medium P in the recording medium carriage direction. In addition, a distance from the position of the second sensor 202 to a nip position of the removing plate 205 and the second plate 204 is a length of ½ the length of the recording medium P in the recording medium carriage direction.

That is, a length of the sum of the distance from the position of the first sensor 201 and the nip position of the removing plate 205 and the first plate 203, and the distance from the position of the second sensor 202 and the nip position of the removing plate 205 and the second plate 204 is the same as the length of the recording medium P carried in the recording medium carriage direction. A plurality of the first sensor 201 and the second sensor 202 may be provided in response to the length of the recording medium P in the recording medium carriage direction.

The first driving roller 217 is disposed between the first sensor 201 and the removing plate 205, and the second driving roller 213 is disposed between the second sensor 202 and the removing plate 205.

Figure 7:
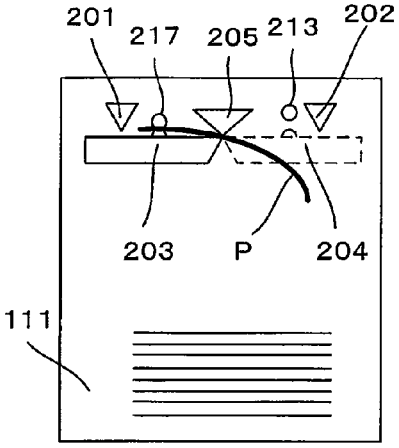
FIG. 7 is a diagram illustrating a state of the foreign matter removing apparatus during foreign matter removal.
Figure 8:
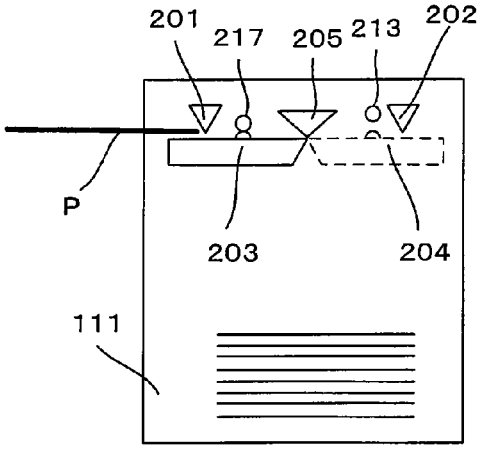
FIG. 8 is a diagram illustrating a state of the foreign matter removing apparatus during the foreign matter removal.

FIG. 7 and FIG. 8 are diagrams illustrating the states of the foreign matter removing apparatus 200 during foreign matter removal. As illustrated in FIG. 7, the foreign matter removing apparatus 200 lowers the removing plate 205 and nips the recording medium P with the first plate 203. In addition, as illustrated in FIG. 8, the foreign matter removing apparatus 200 reverses the first driving roller 217 to pull the recording medium P back until the recording medium is not detected by the first sensor 201.

Therefore, foreign matter attached to the first half part of the recording medium is removed by the removing plate 205 and the first plate 203.

Figure 9:
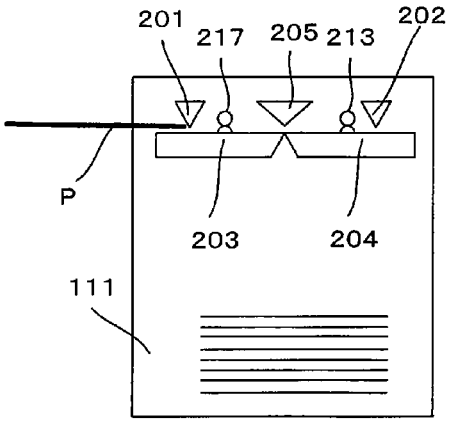
FIG. 9 is a diagram showing an operation of the foreign matter removing apparatus during carriage of the second half of the recording medium.
Figure 10:
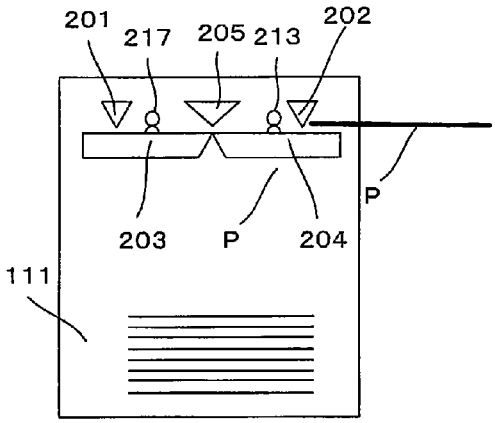
FIG. 10 is a diagram showing an operation of the foreign matter removing apparatus during the carriage of the second half of the recording medium.

FIG. 9 and FIG. 10 are diagrams showing an operation of the foreign matter removing apparatus 200 during the carriage of the second half of the recording medium. As illustrated in FIG. 9, the foreign matter removing apparatus 200 lifts the removing plate 205, lowers the second driving roller 213, and closes the second plate 204.

As illustrated in FIG. 10, in the foreign matter removing apparatus 200, the recording medium P is carried by the first driving roller 217, the driven roller which is rotated along the first driving roller 217, the second driving roller 213, and a driven roller which is rotated along the second driving roller 213, until the recording medium P is not detected after the second sensor 202 detects the recording medium.

Figure 11:
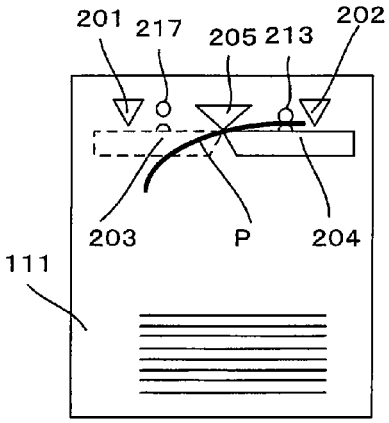
FIG. 11 is a diagram illustrating a state of the foreign matter removing apparatus during the foreign matter removal.
Figure 12:
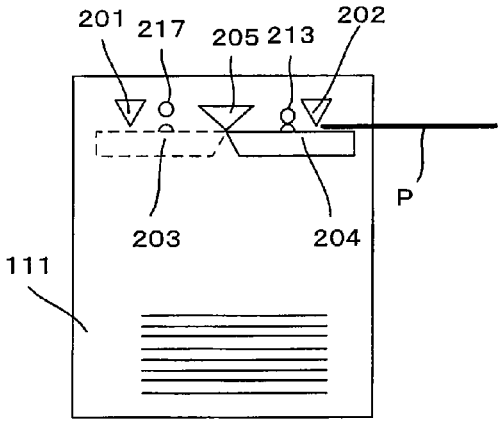
FIG. 12 is a diagram illustrating a state of the foreign matter removing apparatus during the foreign matter removal.

FIG. 11 and FIG. 12 are diagrams illustrating the states of the foreign matter removing apparatus 200 during the foreign matter removal. As illustrated in FIG. 11, the foreign matter removing apparatus 200 lifts the first driving roller 217, opens the first plate 203, and reverses the second driving roller 213 to be carried until the recording medium P is not detected after the second sensor detects the recording medium. Therefore, the second half part of the recording medium P hangs down inside the waste box 111.

Next, the foreign matter removing apparatus 200 lowers the removing plate 205 and nips the recording medium P with the second plate 204. In addition, as illustrated in FIG. 12, the second driving roller 213 is rotated to carry the recording medium P.

Therefore, foreign matter attached to the second half part of the recording medium is removed by the removing plate 205 and the second plate 204.

Next, the foreign matter removing apparatus 200 lowers the first driving roller 217, closes the first plate 203, lifts the removing plate 205, opens the second plate 204, lifts the second driving roller 213, and lifts the removing plate 205 to return its state to the state illustrated in FIG. 5. Then, the foreign matter removing apparatus waits for an insertion of the next recording medium.

Alternatively, the operation of the foreign matter removing apparatus 200 during the carriage of the second half of the recording medium may be performed as follows.

Figure 13:
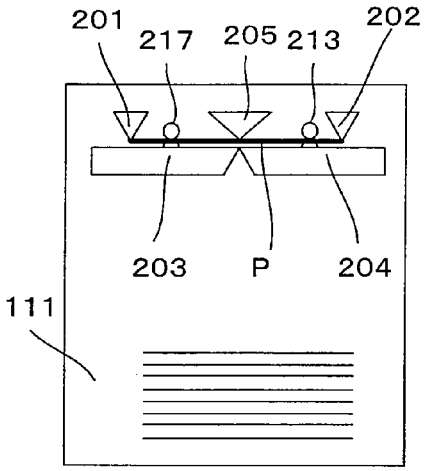
FIG. 13 is a diagram illustrating an application of the operation of the foreign matter removing apparatus during the carriage of the second half of the recording medium.
Figure 14:
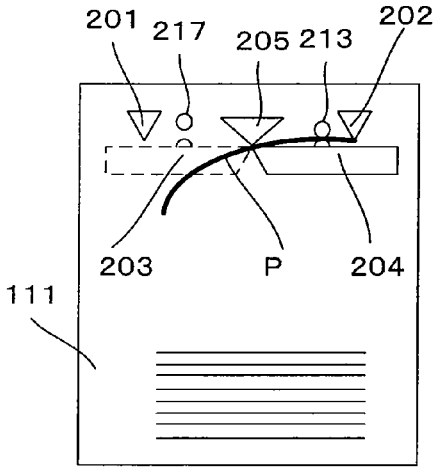
FIG. 14 is a diagram illustrating an application of the operation of the foreign matter removing apparatus during the carriage of the second half of the recording medium.

FIG. 13 and FIG. 14 are diagrams illustrating applications of the operation of the foreign matter removing apparatus 200 during the carriage of the second half of the recording medium. As illustrated in FIG. 13, the foreign matter removing apparatus 200 lifts the removing plate 205, lowers the second driving roller 213, and closes the second plate 204.

As illustrated in FIG. 13, in the foreign matter removing apparatus 200, the recording medium P is carried by the first driving roller 217, the driven roller which is rotated along the first driving roller 217, the second driving roller 213, and the driven roller which is rotated along the second driving roller 213, until the recording medium is detected by the second sensor 202.

FIG. 14 is a diagram illustrating the state of the foreign matter removing apparatus 200 during the foreign matter removal. As illustrated in FIG. 14, the foreign matter removing apparatus 200 lifts the first driving roller 217 and opens the first plate 203. Therefore, the second half part of the recording medium P hangs down inside the waste box 111.

Next, the foreign matter removing apparatus 200 lowers the removing plate 205 and nips the recording medium P with the second plate 204. In addition, as illustrated in FIG. 12, the second driving roller 213 is rotated to carry the recording medium P.

Therefore, foreign matter attached to the second half part of the recording medium is removed by the removing plate 205 and the second plate 204.

Next, the foreign matter removing apparatus 200 lowers the first driving roller 217, closes the first plate 203, lifts the removing plate 205, opens the second plate 204, lifts the second driving roller 213, and lifts the removing plate 205 to return its state to the state illustrated in FIG. 5. Then, the foreign matter removing apparatus 200 waits for an insertion of the next recording medium.

As described above, the foreign matter removing apparatus 200 according to this embodiment includes the removing plate 205 disposed above the recording medium carriage path, the first sensor 201 and the second sensor 202 which interpose the removing plate 205 therebetween at equal distances in the recording medium carriage direction and are disposed on both sides of the recording medium carriage direction, the first plate 203 and the second plate 204 which come in contact with each other at a position below the removing plate 205, and are disposed at positions opposed to the first sensor 201 and the second sensor 202 while interposing the recording medium carriage path therebetween so as to be opened and closed in the direction perpendicular to the recording medium carriage direction, the first driving roller 217 disposed between the first sensor 201 and the removing plate 205, and the second driving roller 213 disposed between the second sensor 202 and the removing plate 205.

Therefore, there is an advantage that it is possible for the foreign matter removing apparatus 200 to remove foreign matter from the recording medium more reliably.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A foreign matter removing apparatus comprising:

a removing member disposed above a medium path and having an edge;

a nipping plate positioned below the removing member across the medium path, wherein the removing member is moveable relative to the nipping plate so that a gap between the edge of the removing member and the nipping plate can be selectively narrowed to nip a medium when the medium is located at a position between the edge and the nipping plate, the position being determined based on a first medium sensor and a second medium sensor disposed on opposite sides of the removing member along the medium path; and a medium conveying mechanism configured to convey the medium along the medium path while the medium is nipped between the edge of the removing member and the nipping plate so that foreign matter is removed from the medium by the edge as the medium is conveyed.

2. The apparatus according to claim 1, wherein the medium conveying mechanism includes a first driving roller disposed between the first medium sensor and the removing member, and a second driving roller disposed between the second medium sensor and the removing member, and the nipping plate includes a first plate disposed at a position below the first medium sensor across the medium path and moveable in a direction perpendicular to a medium conveyance direction, and a second plate configured to be in contact with the first plate at a position under the removing member, disposed below the second medium sensor across the medium path, and moveable in a direction perpendicular to the medium conveyance direction.

3. The apparatus according to claim 2, further comprising:

a control unit configured to cause the removing member to move up, the first driving roller to move down, the first plate to be positioned along the medium path, the second driving roller to move up, the second plate to be positioned out of the medium path, and the first driving roller to rotate in the medium conveyance direction, thereby causing a front part of the medium to hang down.

4. The apparatus according to claim 2, wherein when the removing member moves down, the medium is nipped between the edge of the removing member and the first plate, and the first driving roller is configured to rotate in a reverse direction opposite to the medium conveyance direction to pull the medium back.

5. The apparatus according to claim 2, further comprising:

a control unit configured to cause the removing member to move up, the first driving roller to move up, the first plate to be positioned out of the medium path, the second driving roller to move down, the second plate to be positioned along the medium path, and the second driving roller to rotate in a reverse direction opposite to the medium conveyance direction, thereby causing a rear part of the medium to hang down.

6. The apparatus according to claim 2, wherein the removing member moves down, the medium is nipped between the edge of the removing member and the second plate, and the second driving roller is configured to rotate in the medium conveyance direction to convey the medium.

7. The apparatus according to claim 2, further comprising:

a color erasing unit configured to perform an erasing process with respect to on the medium; and a control unit configured to perform a foreign matter removing operation when an instruction to perform the foreign matter removing operation is input.

8. A color erasing apparatus comprising:

a medium conveying mechanism configured to convey a medium;

a removing member disposed above a medium path and having an edge;

a nipping plate positioned below the removing member across the medium path, wherein the removing member is moveable relative to the nipping plate so that a gap between the edge of the removing member and the nipping plate can be selectively narrowed to nip a medium when the medium is located at a position between the edge and the nipping plate, the position being determined based on a first medium sensor and a second medium sensor disposed on opposite sides of the removing member along the medium path, the first medium sensor being disposed upstream with respect to the second medium sensor in a medium conveyance direction; and a heating device disposed downstream with respect to the second medium sensor in the medium conveyance direction and configured to heat an image on the medium at a color-erasing temperature or higher, wherein the medium conveying mechanism is further configured to convey the medium along the medium path while the medium is nipped between the edge of the removing member and the nipping plate so that foreign matter is removed from the medium by the edge as the medium is conveyed.

9. The apparatus according to claim 8, wherein the medium conveying mechanism includes a first driving roller disposed between the first medium sensor and the removing member, and a second driving roller disposed between the second medium sensor and the removing member, and the nipping plate includes a first plate disposed below the first medium sensor across the medium path and configured to move in a direction perpendicular to a medium conveyance direction, and a second plate configured to be in contact with the first plate at a position under the removing member, disposed below the second medium sensor across the medium path, and move in a direction perpendicular to the medium conveyance direction.

10. The apparatus according to claim 9, further comprising:

a control unit configured to cause the removing member to move up, the first driving roller to move down, the first plate to be positioned along the medium path, the second driving roller to move up, the second plate to be positioned out of the medium path, and the first driving roller to rotate in the medium conveyance direction, thereby causing a front part of the medium to hang down.

11. The apparatus according to claim 9, wherein when the removing member moves down, the medium is nipped between the edge of the removing member and the first plate, and the first driving roller is configured to rotate in a reverse direction opposite to the medium conveyance direction to pull the medium back.

12. The apparatus according to claim 9, further comprising:

a control unit configured to cause the removing member to move up, the first driving roller to move up, the first plate to be positioned out of the medium path, the second driving roller to move down, the second plate to be positioned along the medium path, and the second driving roller to rotate in a reverse direction opposite to the medium conveyance direction, thereby causing a rear part of the medium to hang down.

13. The apparatus according to claim 9, wherein the removing member moves down, the medium is nipped between the edge of the removing member and the second plate, and the second driving roller is configured to rotate in the medium conveyance direction to convey the medium.

14. The apparatus according to claim 9, further comprising:

a display apparatus configured to display a screen to which an instruction to perform a foreign matter removing operation is input; and a control unit configured to perform the foreign matter removing operation when the instruction to perform the foreign matter removing operation is input.

15. The apparatus according to claim 9, further comprising:

a waste box disposed below the first plate and the second plate to receive the removed foreign matter therein.

16. A foreign matter removing method comprising:

nipping a medium between a removing member disposed above a medium path and having an edge and a nipping plate disposed below the medium path, when the medium is located at a position between the edge and the nipping plate, the position being determined based on a first medium sensor and a second medium sensor that are disposed on opposite sides of the removing member along the medium path; and conveying the medium while the medium is nipped between the edge of the removing member and the nipping plate so that foreign matter is removed from the medium by the edge as the medium is conveyed.

17. The method according to claim 16, wherein the nipping plate includes a first plate disposed at a position below the first medium sensor and moveable in a direction perpendicular to a medium conveyance direction, and a second plate in contact with the first plate at a position under the removing member, disposed below the second medium sensor across the medium path, and moveable in a direction perpendicular to the medium conveyance direction.

18. The method according to claim 17, wherein the nipping includes lifting up the removing member, lowering a first driving roller disposed between the first medium sensor and the removing member, positioning the first plate along the medium path, lifting up a second driving roller disposed between the second medium sensor and the removing member, positioning the second plate out of the medium path, rotating the first driving roller in the medium conveyance direction to cause a front part of the medium to hang down, lowering the removing member, such that the medium is nipped between the edge of the removing member and the first plate.

19. The method according to claim 17, wherein the nipping includes lifting up the removing member, lifting up a first driving roller disposed between the first medium sensor and the removing member, positioning the first plate out of the medium path, lowering a second driving roller disposed between the second medium sensor and the removing member, positioning the second plate along the medium path, rotating the second driving roller in a direction opposite to the medium conveyance direction to cause a rear part of the medium to hang down, lowering the removing member, such that the medium is nipped between the edge of the removing member and the second plate.

20. The method according to claim 19, wherein performing a foreign matter removing operation when an instruction to perform the foreign matter removing operation is input from a display apparatus.

* * * * *